US006145193A

United States Patent [19]

Gauker

[11] Patent Number: 6,145,193

[45] **Date of Patent: *Nov. 14, 2000**

[54] METHOD OF FORMING A SQUIB CONNECTOR SOCKET ASSEMBLY HAVING SHORTING CLIP FOR AUTOMOTIVE AIR BAGS

[75] Inventor: Bradford K. Gauker, Clinton Township, Mich.

[73] Assignee: Thomas & Betts International, Inc., Sparks, Nev.

[ * ] Notice: This patent issued on a continued prosecution application filed under 37 CFR 1.53(d), and is subject to the twenty year patent term provisions of 35 U.S.C. 154(a)(2).

[21] Appl. No.: 09/190,596

[22] Filed: Nov. 12, 1998

Related U.S. Application Data

[62] Division of application No. 08/703,990, Aug. 28, 1996.

[51] Int. Cl.[7] ..... H01R 43/04

[52] U.S. Cl. ..... 29/882; 439/188

[58] Field of Search ..... 29/869, 871, 873, 29/881, 882; 439/188

[56] References Cited

U.S. PATENT DOCUMENTS

| | | | |
|---|---|---|---|
| Re. 34,693 | 8/1994 | Plocek et al. | 439/15 |
| 3,460,234 | 8/1969 | Iantorno | 29/432.1 |
| 3,997,224 | 12/1976 | Ogawa et al. | 339/5 M |
| 4,006,954 | 2/1977 | Ikawa et al. | 339/8 R |
| 4,070,081 | 1/1978 | Takahashi | 339/91 R |
| 4,179,175 | 12/1979 | Farnworth et al. | 339/42 |
| 4,417,775 | 11/1983 | Sakurai et al. | 339/5 M |
| 4,422,699 | 12/1983 | Sakurai et al. | 339/3 S |
| 4,462,648 | 7/1984 | Fohl | 339/3 S |
| 4,623,209 | 11/1986 | Mangone | 339/75 P |
| 4,687,278 | 8/1987 | Grabbe et al. | 439/842 |
| 4,722,551 | 2/1988 | Adams | 280/736 |
| 4,786,258 | 11/1988 | Shaffer et al. | 439/188 |
| 4,813,882 | 3/1989 | Ruiz | 439/101 |
| 4,850,888 | 7/1989 | Denlinger et al. | 439/188 |
| 4,867,699 | 9/1989 | Oda et al. | 439/355 |
| 4,871,325 | 10/1989 | Maejima et al. | 439/353 |
| 4,875,875 | 10/1989 | Archer et al. | 439/401 |
| 4,878,853 | 11/1989 | Yamade et al. | 439/144 |
| 4,884,978 | 12/1989 | Inaba et al. | 439/352 |
| 4,893,109 | 1/1990 | Vrabel et al. | 340/438 |
| 4,904,190 | 2/1990 | Plocek et al. | 439/15 |
| 4,906,203 | 3/1990 | Margrave et al. | 439/188 |
| 4,919,620 | 4/1990 | Yamaguchi et al. | 439/15 |
| 4,941,839 | 7/1990 | Nagasaka et al. | 439/352 |
| 4,943,240 | 7/1990 | Karlsson | 439/15 |
| 4,973,859 | 11/1990 | Shodai | 307/10.1 |
| 4,978,191 | 12/1990 | Hasegawa et al. | 350/96.2 |
| 4,978,311 | 12/1990 | Oda et al. | 439/188 |
| 4,988,307 | 1/1991 | Muzslay | 439/188 |
| 4,992,064 | 2/1991 | Steinhardt et al. | 439/845 |
| 4,993,967 | 2/1991 | Matsumoto | 439/489 |
| 5,009,604 | 4/1991 | Plocek et al. | 439/15 |

(List continued on next page.)

FOREIGN PATENT DOCUMENTS

| | | |
|---|---|---|
| 0601564A2 | 6/1994 | European Pat. Off. . |
| 4010440C1 | 10/1991 | Germany . |

*Primary Examiner*—Carl J. Arbee
*Assistant Examiner*—Bobby Rushing, Jr.
*Attorney, Agent, or Firm*—Weingarbin, Schurgin, Gagnebin & Hayes LLP

[57] ABSTRACT

A squib connector socket assembly for automotive air bags includes a shorting clip assembly. The squib connector socket assembly holds a pair of igniter pins of a squib assembly which are connectable to a pair of terminals in a squib connector which plugs into the socket assembly. To prevent accidental firing when the squib connector is removed, the igniter pins are shorted by a shorting clip having a pair of resilient, bowed beams which are independently biassed into contact with the pins. The shorting clip is fixedly retained within a plastic socket insert. The socket insert and squib assembly are assembled within a metal socket which is roll crimped about the insert and squib assembly to form an inseparable, integral squib connector socket assembly.

8 Claims, 3 Drawing Sheets

U.S. PATENT DOCUMENTS 5,010,784 4/1991 Nakazato et al. ..... 74/498
5,011,423 4/1991 Reuter ..... 439/341
5,015,199 5/1991 Hirano et al. ..... 439/353
5,045,641 9/1991 Urushibata et al. ..... 174/74 R
5,055,058 10/1991 Nagasaka et al. ..... 439/188
5,067,916 11/1991 Denlinger et al. ..... 439/857
5,069,632 12/1991 Avitan ..... 439/188
5,086,284 2/1992 Mouissie ..... 335/205
5,106,324 4/1992 Natsume ..... 439/510
5,108,309 4/1992 Oda et al. ..... 439/595
5,135,408 8/1992 Suzuki ..... 439/310
5,136,275 8/1992 Madau et al. ..... 340/438
5,139,438 8/1992 Gaffney ..... 439/352
5,145,356 9/1992 Minnis ..... 439/352
5,149,127 9/1992 Manabe et al. ..... 280/731
5,174,785 12/1992 Endo et al. ..... 439/489
5,174,786 12/1992 Kato et al. ..... 439/489
5,178,547 1/1993 Bonas et al. ..... 439/34
5,186,639 2/1993 Comerci et al. ..... 439/188
5,200,574 4/1993 Cunningham et al. ..... 102/530
5,226,830 7/1993 Ueno ..... 439/164
5,236,419 8/1993 Roeder et al. ..... 439/164
5,241,910 9/1993 Cunningham et al. ..... 102/530
5,259,773 11/1993 Champion et al. ..... 439/108
5,275,575 1/1994 Cahaly et al. ..... 439/188
5,277,608 1/1994 Oda ..... 439/188
5,279,225 1/1994 Dow et al. ..... 102/202.2
5,295,846 3/1994 Sumida et al. ..... 439/188
5,297,976 3/1994 VanDerStuyf et al. ..... 439/271
5,306,180 4/1994 Buhr ..... 439/620
5,310,362 5/1994 Bäuerle et al. ..... 439/620
5,314,341 5/1994 Kazita et al. ..... 439/15
5,314,345 5/1994 Cahaly et al. ..... 439/188
5,316,507 5/1994 Capp ..... 439/886
5,324,074 6/1994 Christian et al. ..... 280/728 R
5,326,290 7/1994 Chailleux et al. ..... 439/862
5,358,433 10/1994 Dechanteloup et al. ..... 439/843
5,370,543 12/1994 Hamada et al. ..... 439/188
5,376,017 12/1994 Taniuchi et al. ..... 439/372
5,378,165 1/1995 Comerci et al. ..... 439/188
5,389,002 2/1995 Matsuda et al. ..... 439/164
5,391,087 2/1995 Fukuda ..... 439/188
5,401,180 3/1995 Muzslay ..... 439/188
5,435,754 7/1995 Hotea et al. ..... 439/620
5,454,593 10/1995 Armstrong et al. ..... 280/741
5,458,371 10/1995 Fulmer et al. ..... 280/741
5,462,449 10/1995 Tsuji et al. ..... 439/188
5,468,163 11/1995 Egenolf ..... 439/839
5,482,316 1/1996 Lang et al. ..... 280/741
5,505,631 4/1996 Schauer et al. ..... 439/188
5,590,899 1/1997 Nakane et al. ..... 280/728.2
5,653,606 8/1997 Chrysostomou ..... 439/352
5,711,574 1/1998 Barnes ..... 297/216.11
5,898,122 4/1999 Davis et al. ..... 102/206

METHOD OF FORMING A SQUIB CONNECTOR SOCKET ASSEMBLY HAVING SHORTING CLIP FOR AUTOMOTIVE AIR BAGS

This application is a division of Ser. No. 08/703,990 filed Aug. 28, 1996.

FIELD OF THE INVENTION

This invention relates to the field of automotive air bags and more particularly to squib connectors for automotive air bags.

BACKGROUND OF THE INVENTION

Supplemental inflatable restraints or air bag assemblies are becoming increasingly common as a safety device in vehicles throughout the world. The assembly comprises an inflatable canister located in the steering column, the passenger-side dashboard, or the side door panel. Upon a sufficiently great deceleration, the canister is inflated by an explosive device known as a squib which contains a gun powder-based material. The squib is fired electronically upon an electrical signal sent via wires from a deceleration or other sensor in the vehicle. The wires are attached to the squib via a squib connector which plugs into a receptacle or inflator socket in the squib assembly.

A common form of squib has two pins which extend within the socket, and an associated connector has two terminals which are in electrical contact with the pins when the connector is plugged into the socket. When the connector is removed from the socket, typically for servicing, a shorting clip or shunt is biassed into electrical contact with the two pins to form an electrical connection therebetween to reduce the risk of misfiring, for example, by static electricity. The connector urges the shorting clip out of electrical contact with the pins when the connector is plugged into the socket.

In a common prior art squib connector socket assembly, the socket is machined from aluminum and has a machined opening therein to receive the squib assembly and connector. However, machining is prone to depositing metal burrs and shavings in the socket, which can increase the risk of accidental firing. Additionally, it can be difficult to meet the required dimensional tolerances with machining. This socket assembly is also relatively expensive to manufacture. Further prior art squib connector and shorting clip assemblies are shown in U.S. Pat. Nos. 5,275,575, 5,401,180, and 5,435,754.

SUMMARY OF THE INVENTION

The present invention provides a squib connector socket assembly including a shorting clip which eliminates the problems of metal burrs, is dimensionally stable, and can be economically manufactured in high volume and low cost. The squib connector socket assembly includes a metal inflator socket and a shorting clip assembly. The shorting clip assembly includes a shorting clip fixedly disposed inside a plastic socket insert. The plastic socket insert can be readily injection molded at low cost and high volume, does not generate metal burrs, and is dimensionally stable. The inflator socket can be impact or cold head extruded, also at low cost and high speed.

The shorting clip, formed of a resilient, electrically conductive material, includes two beams which are biassed into contact with the pins of a squib assembly. The beams are able to act independently to make contact with the pins even if the pins are not parallel.

In assembly, the pins of the squib assembly are inserted into openings in the base of the plastic socket insert. The squib assembly and plastic insert are placed in the socket, and the socket is crimped around the insert and squib assembly to retain them within the socket in an inseparable, integral final assembly. When a squib connecter is plugged into the socket, the connector urges the beams of the shorting clip out of electrical contact with the pins. When the squib connector is unplugged from the socket, the resilience of the shorting clip biases the beams back into contact with the pins.

DESCRIPTION OF THE DRAWINGS

The invention will be more fully understood from the following detailed description taken in conjunction with the accompanying drawings in which.

DETAILED DESCRIPTION OF THE INVENTION

Figure 3:
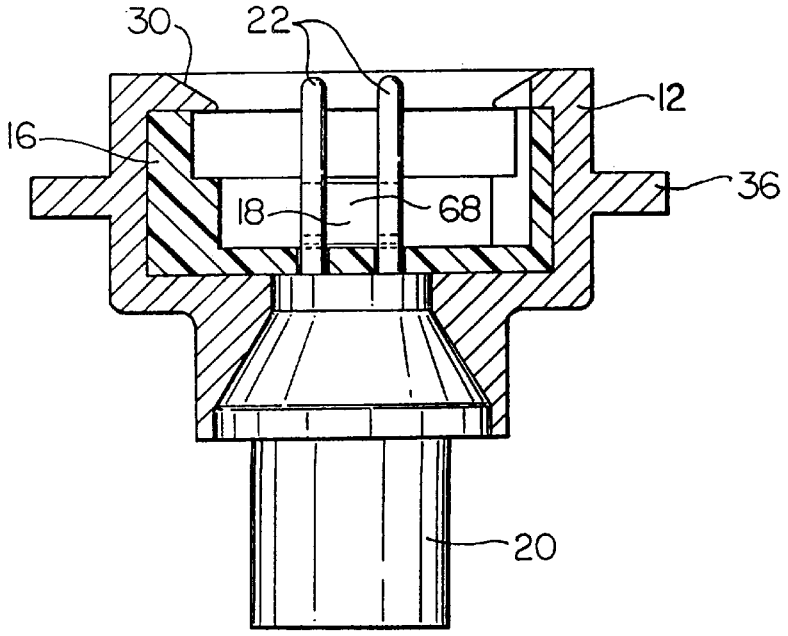
FIG. 3 is a cross-sectional side view taken along line A—A of FIG. 2.

The squib connector socket assembly of the present invention includes an inflator socket 12 and a shorting clip assembly 14 for use with inflation canisters of driver's side, passenger side, or side door air bags. The shorting clip assembly 14 includes a socket insert 16 which fits within the inflator socket 12, and a shorting clip 18 fixedly disposed inside the socket insert. In the assembled configuration, a squib assembly 20 having a pair of igniter pins 22 is received in the socket insert 16, and the inflator socket 12 is roll crimped about the socket insert 16 and the squib assembly 20 to form an integral squib and socket assembly, best seen in FIGS. 3 and 4. The squib assembly may be any two-pin squib assembly as would be known in the art.

Figure 1:
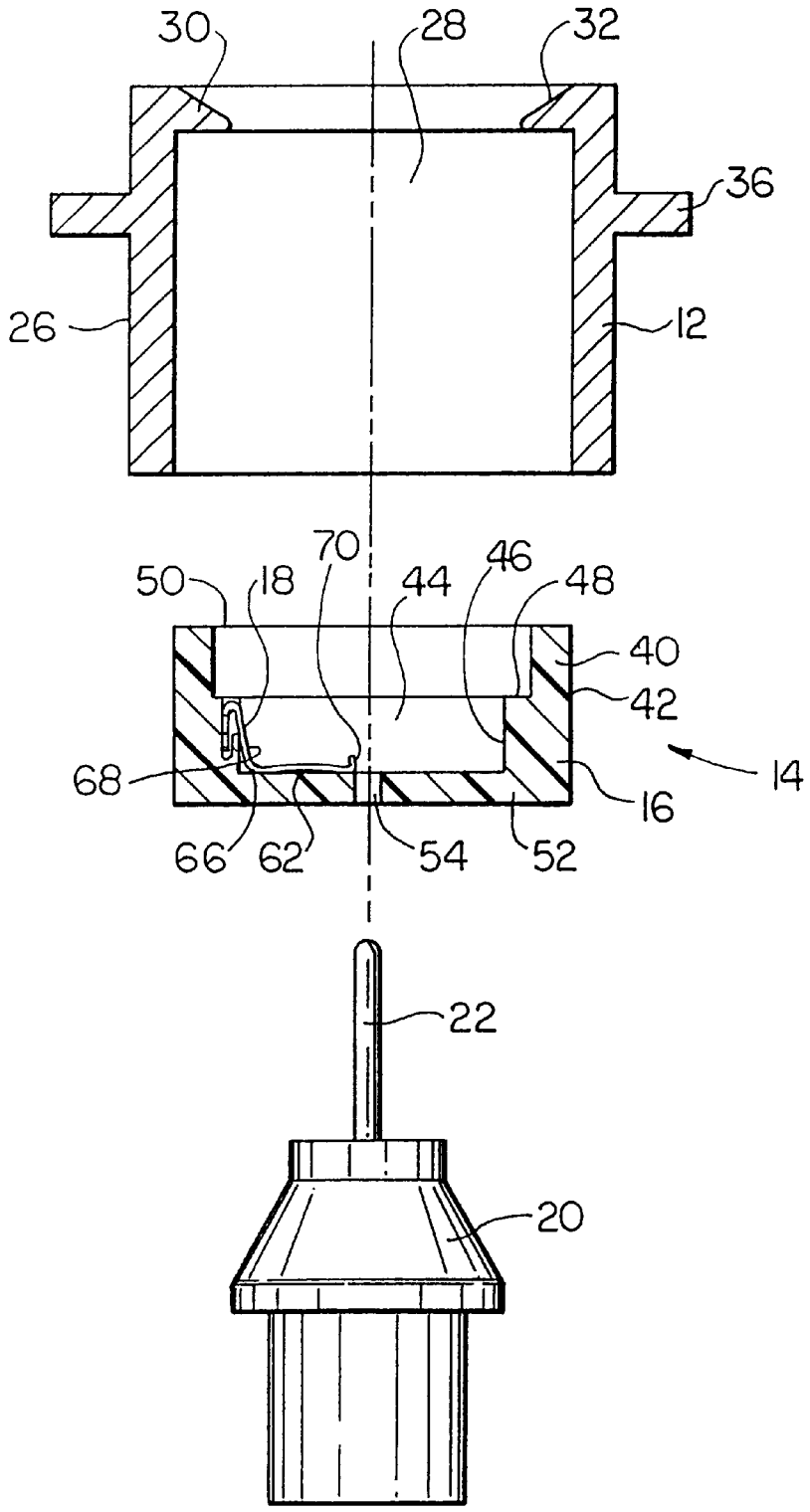
FIG. 1 is an exploded view of a squib connector socket assembly according to the present invention.
Figure 2:
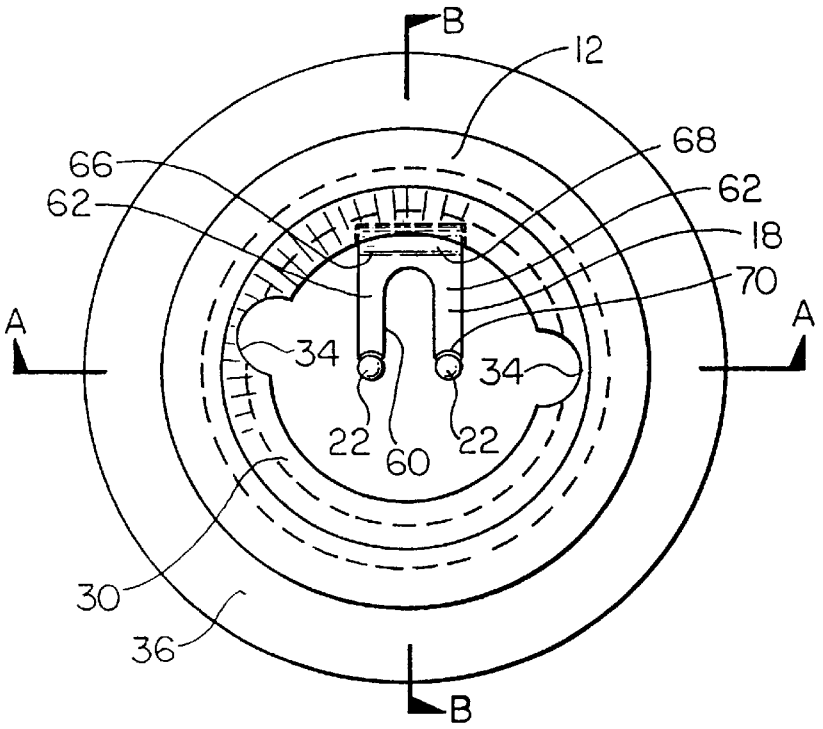
FIG. 2 is a top plan view of the squib connector socket assembly of FIG. 1 in an assembled configuration.

In the unassembled configuration, shown more particularly in FIG. 1, the inflator socket 12 is generally tubular, having a cylindrical exterior surface 26 and an interior space 28 for receiving the socket insert. An interiorly facing annular lip 30 is provided along an upper end of the socket to retain the socket insert therein. The lip may have a slope 32 on an exterior surface thereof to ease entry of a squib connector (not shown) into the socket assembly. Cut outs 34, shown in FIG. 2, may also be provided in the lip 30 for orientation of the squib connector. The inflator socket 12 is formed of aluminum, stainless steel, or other suitable metal, preferably by an impact or cold headed extrusion process, although other processes may be used. An annular flange 36 or other suitable structure may be formed, as by welding or roll forming, around the exterior of the inflator socket for fastening the socket to an air bag assembly.

The socket insert 16 is generally formed of a plastic material such as a nylon, polybutylene terephthalate (PBT), acetal, polyphenylene sulfide (PPS), liquid crystal polymer (LCP), or other suitable material, preferably by an injection molding process, although other processes may be used. The insert has a side wall 40 having a cylindrical exterior surface 42 with an outer diameter corresponding to the inner diameter of the cylindrical interior space 28 of the inflator socket 12. The insert includes an interior section 44 defined by the interior surface 46 of the side wall. As shown, the side wall interior surface 46 is cylindrical, although other interior surface configurations, such as one or more flat surfaces, may be provided. The interior of the side wall may include a lip or shoulder 48 for receiving a latching mechanism of a squib connector (not shown). The insert 16 is open on one end 50 for receiving the squib connector. The insert further includes a bottom wall 52 on the end opposite the open end. Two openings 54 are formed in the bottom wall which are sized and spaced to receive the pins 22 of the squib assembly 20.

The shorting clip 18 is formed of a resilient, electrically conductive material such as a beryllium-copper alloy. The clip is formed from a single piece of a generally rectangular configuration having a U-shaped cut-out 60 in one portion to form two beams 62. A bend 66 transverse to the length of the beams is formed slightly beyond the base of the beams to define an upstanding member 68. The angle between the beams 62 and the upstanding member 68 formed by the bend 66 is slightly greater than 90°, as discussed further below.

In assembly, the clip 18 is placed in the insert 16 with the beams 62 extending along the bottom wall 52 of the insert and the upper edge of the upstanding member 68 placed against and fixedly attached, as by stitching, to the interior of the wall 40. Alternatively, the clip can be over molded into the insert. The upstanding member 68 may be curved, at least along an upper portion thereof, to conform to the curvature of the interior surface 46 of the insert. Alternatively, the interior surface may be provided with a flat surface adjacent the clip. Since the angle between the beams and the upstanding member is greater than 90°, the upstanding member diverges from the interior wall toward the bottom wall by a small angle, as best seen in FIGS. 1 and 4.

The beams include lips 70 on the outer ends thereof to contact the pins 22 of the squib assembly 20 when inserted through the holes 54 in the insert 16. A stripe of an electrically conductive material such as gold is preferably plated on the lips to provide good electrical contact with the pins. Other conductive materials, such as silver, palladium, or silver/palladium alloys, which can be plated or otherwise suitably deposited onto the lips can be used. The lips 70 may be curved to wrap around the pins 22, thereby ensuring at least two points of contact between the lips and the pins. The ends of the lips are angled slightly away from the pins to allow a squib connector to fit between the beams 62 and the pins 22, thereby providing a dielectric insulation between beams 62 and pins 22.

Figure 4:
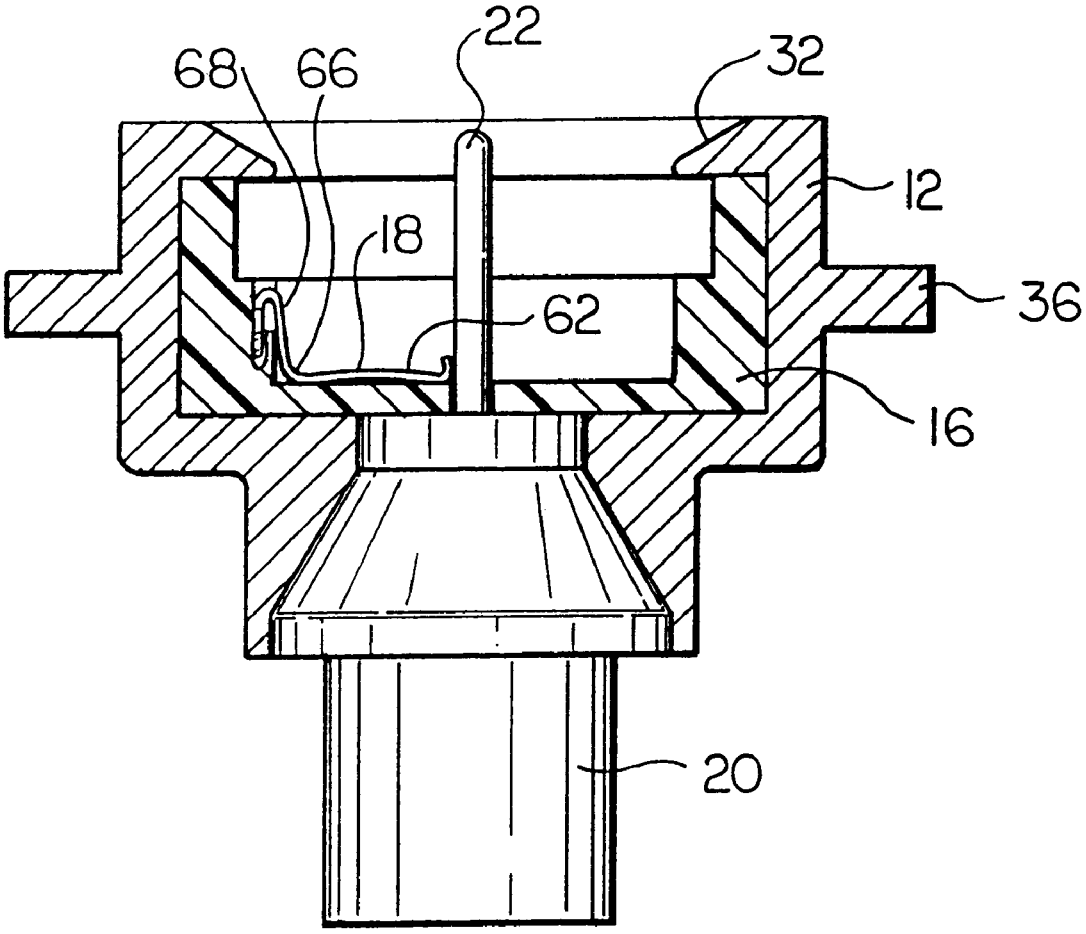
FIG. 4 is a cross-sectional side view taken along line B—B of FIG. 2.

Each beam 62 is formed with a slight bow along its length such that the beams rest along the bottom wall 52 at a point near the bend 66 and at a point near the lip 70, best seen in FIGS. 1 and 4. The length of the beam 62 and the location of the bend forming the lip 70 are chosen such that, in the unconstrained position, when no igniter pin 22 is inserted in the socket, the bend forming the lip 70 lies at or slightly over the opening 54 in the bottom wall 52 of the insert 16. In this manner, when an igniter pin 22 is present in the socket, the pin 22 exerts a compressive force on the beam 62 tending to push the beam toward the cylindrical wall 40 of the socket insert 16. Since the clip 18 is fixed to the insert 16, this compressive force tends to further bow the beam 62. The resistance of the bow causes the beam to be biassed into contact with the pin, thereby maintaining good electrical contact. Furthermore, the two beams act independently, such that one beam can be bowed more than the other beam if, for example, the igniter pins of the squib assembly are not parallel. In addition, as noted above, the bend between the upstanding member 68 and the beams 62 is slightly greater than 90°. When a connector is pushed into the insert 16, the beam is pushed toward the cylindrical wall 40, the bend is reduced slightly and the upstanding member 68 is pushed closer to the wall 40 of the insert 16. The clip 18 moves outward toward the wall 40 of the insert 16, pulling the two beams 62 away from the pins 22. The angle of the bend 66 between the beams 62 and the upstanding member 68 is generally 10°; the exact angle can be readily chosen by one skilled in the art to achieve the desired biassing effect.

When a squib connector (not shown) is inserted into the socket 12 through the opening, the connector is able to fit between the lips 70 of the beams 62 and the pins 22 providing a dielectric insulation between the beams 62 and the pins 22. When the connector is removed, the resilience of the bowed beams and the bend between the beams and the upstanding member bias the beams back into contact with the pins.

The shorting clip is useful for preventing accidental firing of an air bag during servicing when a mechanic removes the connector. Such accidental firing may be caused, for example, by static electricity. However, some squib assemblies are not intended to be serviced, and in such cases the squib connector is not removable by a mechanic. A shorting clip is accordingly not necessary in such designs. In the present invention, the inflator socket and socket insert can also be used with non-serviceable squib assemblies, in which case the shorting clip may be left out of the assembly.

The squib connector socket assembly of the present invention is readily manufactured at high volume and low cost relative to prior art machined sockets with shorting clips. The injection molding process for the plastic insert eliminates the presence of metal burrs and slivers and is dimensionally more reliable than machining processes. The shorting clip design can readily accommodate igniter pins which are not parallel. Also, although described in relation to a two-pin squib assembly, the invention is applicable to squib assemblies with other numbers of pins. Crimping the extruded inflator socket about the insert and squib assembly results in an inseparable, integral final assembly. The squib connector socket assembly is sufficiently versatile that it can be used for both serviceable and non-serviceable squib assemblies; in the latter case, the shorting clip may be left out of the final assembly.

The invention is not to be limited by what has been particularly shown and described, except as indicated by the appended claims.

I claim:

1. A method of forming a squib connector socket assembly for an automotive air bag, comprising:

fixing a resilient, electrically conductive shorting clip into a plastic socket insert, the socket insert having a bottom wall having two openings therein, the shorting clip configured for biassing contact with two igniter pins of a squib assembly;

inserting the two igniter pins of the squib assembly into the two openings of the plastic socket insert with the shorting clip biassed into electrical contact with the igniter pins;

inserting the plastic socket insert and the squib assembly into a metal inflator socket having an exterior tubular configuration and opposed open ends; and crimping the inflator socket about the socket insert and the squib assembly to form an integral assembly.

2. The method of claim 1, wherein the socket insert is formed by injection molding.

3. The method of claim 1, wherein the socket insert is formed of a nylon, polybutylene terephthalate, acetal, polyphenylene sulfide, or liquid crystal polymer.

4. The method of claim 1, wherein the shorting clip is fixed to the socket insert by stitching.

5. The method of claim 1, wherein the shorting clip is molded into the socket insert.

6. The method of claim 1, wherein the shorting clip is formed of a beryllium and copper alloy.

7. The method of claim 1, wherein the inflator socket is formed by cold headed extrusion.

8. The method of claim 1, wherein the inflator socket is formed of aluminum or stainless steel.

* * * * *